US011383920B2

(12) United States Patent
Wicks

(10) Patent No.: US 11,383,920 B2
(45) **Date of Patent: *Jul. 12, 2022**

(54) BEVERAGE PREPARATION CAPSULE

(71) Applicant: LAVAZZA PROFESSIONAL NORTH AMERICA, LLC, West Chester, PA (US)

(72) Inventor: David Wicks, Basingstoke (GB)

(73) Assignee: LAVAZZA PROFESSIONAL NORTH AMERICA, LLC, West Chester, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/165,174

(22) Filed: Feb. 2, 2021

(65) Prior Publication Data

US 2021/0155400 A1 May 27, 2021

Related U.S. Application Data

(63) Continuation of application No. 14/889,521, filed as application No. PCT/GB2014/051433 on Sep. 5, 2014, now Pat. No. 10,940,994.

(30) Foreign Application Priority Data

Sep. 5, 2013 (GB) ..... 1308374

(51) Int. Cl.
*B65D 85/80* (2006.01)
*B65D 85/804* (2006.01)

(52) U.S. Cl.
CPC ..... *B65D 85/8052* (2020.05)

(58) Field of Classification Search
CPC ..... B65D 85/8043; B65D 85/804; B65D 85/8046; B65D 85/8052
See application file for complete search history.

(56) References Cited

U.S. PATENT DOCUMENTS

| | | | |
|---|---|---|---|
| 4,576,316 | A | 3/1986 | Foster |
| 4,640,425 | A | 2/1987 | Cabernoch |
| 4,738,378 | A | 4/1988 | Oakley et al. |
| 4,886,674 | A | 12/1989 | Seward et al. |
| 5,272,960 | A | 12/1993 | Kinna |
| 5,785,428 | A | 7/1998 | Mazzocchi |
| 7,167,886 | B2 | 1/2007 | Gashkov et al. |
| 8,161,868 | B2 | 4/2012 | Bolzicco et al. |
| 2004/0182250 | A1 | 9/2004 | Halliday et al. |
| 2012/0237640 | A1 | 9/2012 | Buffet et al. |

(Continued)

FOREIGN PATENT DOCUMENTS

| | | |
|---|---|---|
| CN | 1964900 | 5/2007 |
| EP | 0179641 | 4/1986 |
| EP | 2241229 | 10/2010 |

(Continued)

*Primary Examiner* — Ericson M Lachica
(74) *Attorney, Agent, or Firm* — The Belles Group PC

(57) ABSTRACT

A beverage preparation capsule comprising a capsule body having a beverage preparation ingredient hermetically sealed therein, wherein a beverage outlet region of said capsule includes front and back sheets of air- and water-impermeable flexible film material arranged in face-to-face relationship along an edge, a folded strip of flexible film material in the form of a gusset extending inwardly from said edge, wherein at least a central region of said strip is provided with a plurality of perforations or a zone of weakness.

19 Claims, 8 Drawing Sheets

(56) References Cited

U.S. PATENT DOCUMENTS

| | | | |
|---|---|---|---|
| 2012/0328739 | A1 | 12/2012 | Nocera |
| 2014/0287104 | A1 | 9/2014 | Austin et al. |

FOREIGN PATENT DOCUMENTS

| | | |
|---|---|---|
| FR | 2527173 | 11/1983 |
| JP | S7188666 | 11/1982 |
| JP | H01226569 | 9/1989 |
| JP | 2003/219968 | 8/2003 |
| JP | H092528 | 11/2008 |
| WO | WO 08204180 | 12/1982 |
| WO | WO 9905045 | 2/1999 |
| WO | WO 2012/175985 | 12/2012 |
| WO | WO 2014/181129 | 11/2014 |

BEVERAGE PREPARATION CAPSULE

CROSS REFERENCE TO RELATED APPLICATIONS

The present application is a continuation of U.S. patent application Ser. No. 14/889,521, filed on Nov. 6, 2015, which is a U.S. national stage application under 35 U.S.C. § 371 of PCT Application No. PCT/GB2014/051433, filed May 9, 2014. The disclosures of these references are incorporated herein by reference in their entireties.

BACKGROUND

The present invention relates to beverage preparation capsules.

A number of beverage making systems are known in which a single serving of the beverage is made by inserting a capsule containing a particulate beverage making ingredient, such as ground coffee, into a beverage making station of a beverage making apparatus. The apparatus then injects water into the capsule, where the beverage making ingredient dissolves in, or infuses into, the water to form the beverage. The beverage flows out of the capsule through a suitable outlet, which may be simply an opening or perforation in the capsule, or it may comprise an outlet tube that pierces an outlet region of the capsule. The capsule may incorporate a filter to prevent passage of solid components such as coffee grounds out of the capsule. Beverage making systems of this general type are described for example in WO 94/01344, EP-A-0512468 and EP-A-0468079 (all Nestle), in U.S. Pat. No. 5,840,189 (Keurig), in EP-A-0272922 (Kenco), in EP-A-0821906 (Sara Lee) and in EP-A-0179641 and WO-A-02/19875 (Mars).

GB-A-2121762, GB-A-2122881, EP-A-0179641, EP-A-0247841 and WO-A-9905044 describe capsule-based beverage preparation systems of the type that are now widely used and marketed by Mars Drinks under the registered trade mark FLAVIA. An exemplary embodiment of a FLAVIA capsule according to the state of the art is shown in FIGS. 1, 2 *a* and 2 *b*.

Referring to FIGS. 1, 2 *a* and 2 *b*, the current FLAVIA-type beverage preparation capsule 100 comprises front and back sheets 110, 112 of a liquid- and air-impermeable sheet material permanently bonded together around their top and side edges as described in more detail below. The front and back sheets are also bonded together along a bottom edge 120 of the capsule, but this bond is releasable under the effect of heat or pressure inside the capsule. For example, the bonding of the bottom edge 120 may be by means of a pressure-sensitive adhesive. Within the capsule 100 is a folded web of filter material 130 bonded to the inside walls of the front and back sheets. The web of filter material supports a beverage preparation ingredient 150, such as ground coffee or leaf tea. The capsule 100 further comprises a nozzle 140 having tubular bore 142. The nozzle is inserted into the top edge of the capsule and bonded in airtight fashion to the front and back sheets, the nozzle being flanged to assist in locating the capsule 100 correctly with a beverage preparation machine. The nozzle bore is initially sealed by a suitable airtight freshness barrier.

In use, the capsule 100 is introduced into a FLAVIA dispensing machine, which comprises a clamp to grip the nozzle under the flange, and a hollow injector tube with a mechanism to insert the hollow injector tube into the nozzle bore, thereby piercing the freshness barrier. The dispensing machine further comprises a source of hot water and a pump to inject the hot water through the injector tube into the capsule. Upon introduction of the hot water through the injector tube and the nozzle bore, the beverage preparation ingredient 150 contained in the capsule 100 is mixed with the hot water and a beverage is brewed. The bottom seam 120 of the capsule 100 opens under the effect of heat and liquid pressure inside the capsule, and the beverage passes through the filter web 130 and the open bottom of the capsule and is collected in a receptacle located at a receptacle station situated directly below the capsule.

Referring to FIG. 2 *a*, the sheet of web material 130 is folded to form a W in cross-section supporting the infusible beverage preparation ingredient 150. Upon introduction of liquid through the liquid conduct, the liquid pressure causes the apex 132 of the W to evert to provide a downwardly convex filter bed as shown in FIG. 2 *b*. The eversion effect assists in the rupture of the pressure-sensitive seal of the bottom seam 120 to dispense a beverage brewed in the capsule. Further details and advantages of the everting filter webs may be found in EP-A-0179641.

With infusion-type beverages where the ingredient in the capsule is to be retained therein after infusion, e.g. ground coffee or leaf tea, the web material is typically a laminar sheet of filter material of a mesh size suitably fine to retain the infused solids while allowing free passage of the liquid beverage. An exemplary filter material is a laminate of melt blown polypropylene sandwiched between layers of non-woven spun-bounded polypropylene. It can also be desirable to use cellulosic materials for reasons of cost and biodegradability. A drawback of the filter web materials is that they have low mechanical strength, so that the filter web may burst during brewing. This problem is exacerbated when cellulosic filter materials are used, since the acidic nature of coffee further weakens such filters.

Referring again to FIG. 1, it can be seen that the bonding between the front and back sheets of the capsule comprises a pair of side seams 116 extending downwardly from a top seam 114 and tapering inwardly at the bottom seam 120. The side seams 116 each include a sealed land 118 extending inwardly to form a 'waist' to the capsule. When the capsule is in use, the additional bonding area of the lands helps to maintain the capsule in a tubular configuration. In particular, the lands 118 reduce the tendency of bottom edge of the capsule to curl upwards as it opens, thereby providing improved control over the flow of beverage from the bottom of the capsule. The lands 118 thus provide a more consistent and regular opening of the capsule. Further details of this feature may be found in EP-A-0247841. However, the additional sealed lands adversely reduce the available volume for containing and brewing the beverage preparation ingredient within the capsule. The cost of manufacturing is also increased as special requirements are introduced to the welding and cutting of the sheet materials.

A need therefore remains for improved beverage preparation capsules, suitably but not exclusively for use in equipment of the FLAVIA type.

SUMMARY

The present application provides a beverage preparation capsule comprising a capsule body having a beverage preparation ingredient hermetically sealed therein, wherein a beverage outlet region of said capsule comprises: front and back sheets of air- and water-impermeable flexible film material arranged in face-to-face relationship along an edge; a folded strip of flexible film material in the form of a gusset extending inwardly from said edge, wherein at least a central region of said strip is provided with a plurality of perforations or a zone of weakness.

Preferably, the front and back sheets of air- and water-impermeable flexible film material define an outlet edge of the beverage outlet region of the capsule. The folded strip of flexible film material in the form of a gusset extends inwardly from said outlet edge.

It will be understood that the term "edge" describes the extremity of the capsule, but is not limited to a terminal end of the front and back sheets of air- and water-impermeable flexible film material. In other words, the edge of the capsule may be provided by the terminal end(s) of the front and back sheets or it may be provided by folding a sheet back onto itself to form front and back sheets. In this way, the folded strip of flexible film material in the form of a gusset includes a distinct strip of folded flexible film material adhered or secured to the terminal end(s) or end region of the front and back sheets of air- and water-impermeable flexible film material, or includes a continuation of the front and back sheets of air- and water-impermeable flexible film material by folding of these front and back sheets into a gusset.

Preferably, the beverage capsule is hermetically sealed. That is to say, the capsule includes a body defining an enclosure that encloses the beverage preparation ingredient in substantially air- and liquid-tight fashion until the capsule is ruptured in use to inject water into the enclosure through an inlet to prepare a beverage from the ingredient inside the enclosure, and to allow the thus-prepared beverage to escape from an outlet created in said outlet region of the capsule during beverage preparation.

The outlet region may be sealed in any convenient way with a seal that can be broken during beverage preparation to allow escape of the beverage through the outlet region. Conveniently, the seal is formed by bonding together the front and back sheets with a heat- and/or pressure-releasable bond.

In one embodiment, the surfaces of the strip opposite said front and back sheets are bonded together to complete a substantially airtight seal in said outlet region, the bonding between the said surfaces being releasable by elevated temperature and/or pressure inside the capsule body to allow a beverage to escape from the body through the strip in use.

In another embodiment the internal surfaces of said front and back sheets of air- and water-impermeable flexible film material are bonded together along a line internal to the gusset strip to complete a substantially airtight seal in said outlet region, the bonding between said surfaces being releasable by elevated temperature and/or pressure inside the capsule body to allow a beverage to escape from the body through the perforations in said strip in use. The bonding is suitably formed along a line suitably extending substantially parallel to the outlet edge of the front and back sheets, but spaced inwardly from the edge and from the inside of the gusset strip so as to hermetically enclose the beverage ingredient without also hermetically enclosing the gusset strip. The terms "internal" and "inwardly" in this context refer to a location closer to the center of the capsule, i.e. above the gusset strip when the outlet edge is located at the bottom of the capsule.

In the above embodiments, the line of bonding is suitably from about 1 mm to about 10 mm wide, for example about 2 mm to about 5 mm wide. The bonding may be provided by a pressure sensitive adhesive, for example as currently used in FLAVIA capsules. This adhesive is released by the combined effect of heat and pressure (optionally assisted by external heating from the beverage making apparatus) when hot water is injected into the capsule. Alternatively, the bonding may be formed by melt bonding of a thermoplastic sealing layer on said surfaces of said gusset strip, or on said internal surfaces of said front and back sheets. For example, the thermoplastic sealing layer suitably has a bonding (softening/melting) temperature lower than the melting point of the internal layers of the laminate forming the sheet material, such that the sealing layer can be melt bonded without significantly reducing the mechanical strength of the sheet. The bonding temperature of the sealing layer can be selected such that the bond is released readily when water at 90-100° C. is injected into the capsule. The use of a heat sealable layer on the body or gusset laminate to form the releasable freshness bond in the capsule offers simpler manufacturing processes, since it is no longer necessary to apply a strip of pressure sensitive adhesive to form the bond.

The term "gusset" herein is used in its normal sense of an insert having an inverted V-shape (or in some embodiments an inverted W-shape) when viewed in transverse cross-section (i.e. along the direction of the outlet edges of the capsule, wherein the long (lateral) edges of the gusset strip adjoin and are bonded to the outlet edges of the said front and back sheets and the vertex of the V is located internally of the said outlet edges and in-between the front and back sheets. In embodiments, the surfaces of the gusset opposite to the front and back sheet are not bonded together. In other embodiments, the surfaces of the gusset opposite to the front and back sheet are bonded together along the short (end) edges only of the gusset strip to prevent expansion of the sides of the capsule in the outlet region during beverage preparation. In any event, the gusset covers and seals the outlet of the capsule but allows limited expansion of the outlet edges of the front and back sheets during beverage preparation, and beverage escapes from the capsule through the perforations in the gusset strip. The gusset both filters the beverage and regulates the opening of the front and back sheets during beverage preparation, thereby removing the need for lands in the side edges of FLAVIA-type capsules.

The perforated strip is inserted in gusset fashion. That is to say, opposed long edges of the strip are bonded to the inside surfaces of the front and back sheets, with the strip folded along its longitudinal axis so that it resides substantially entirely within the opening between said front and back sheets. Suitably, the bonding between the edges of the gusset strip and the open edges of the front and back sheets of the capsule is permanent bonding, that is to say the bonding is maintained under the temperature and pressure conditions during operation of the capsule. The permanent bonding may suitably be melt-bonding, produced for example thermal or ultrasonic sealing. Suitable methods for permanently sealing a folded gusset strip into the base of flexible film containers are well known for the manufacture of so-called "stand-up" pouches and will not be described further.

The position of the gusset strip with the edges of the strip adjoining the outlet edges of the front and back sheets makes the capsules easy to manufacture using existing technology for gusset pouches (also known as stand-up pouches). In this context "adjoining" means that the edges of the strip are located within about 10 mm of the edges of the respective front and back sheets, preferably within about 5 mm, more preferably within about 2 mm, and most preferably substantially exactly aligned with.

In alternative embodiments, the gusset strip may be formed integrally with the front and back sheets. For example, the front and back sheets may be a single sheet of material that is folded in a W-fold along the bottom of the capsule such that the central elements of the fold form the gusset. These embodiments could be especially easy to manufacture, for example by modification of conventional form-fill-seal equipment.

The width of each internal fold of the gusset is suitably from about 5 mm to about 50 mm, more suitably from about 10 mm to about 40 mm, for example from about 15 mm to about 20 mm.

The gusset comprises a flexible film material having perforations or a zone of weakness in at least a central region thereof. The term flexible film material is suitable a thermoplastic film or laminate, such as a polypropylene film. The gusset does not consist only of a woven or nonwoven textile filter element, since such elements alone do not have the mechanical strength or chemical resistance desired for the gusset. However, the gusset may be a laminate of the perforated flexible film material and a nonwoven or woven filter material whereby the film material provides the desired mechanical properties and the nonwoven provides filtration of small particulates in the beverage. In such laminates, the nonwoven layer is located facing the inside of the capsule body. The use of such a laminate allows the perforations in the film layer of the gusset strip to be made larger, thereby increasing the rate of flow of the beverage through the filtration zone of the gusset strip, while maintaining effective filtration of small particles by means of the layer of nonwoven filter material laminated to the gusset strip.

In embodiments, the gusset strip comprises a zone of weakness, the zone of weakness being rupturable by elevated temperature and/or pressure inside the capsule body to provide an opening in the strip to allow a beverage to escape from the body through said strip in use. These embodiments are especially suitable when the capsule contains a water-dispersible beverage ingredient. That is to say an ingredient such as milk liquid concentrate or powder, chocolate liquid concentrate or powder, instant coffee or instant tea, or fruit beverage liquid concentrate or powder. Dispersible ingredients are characterized in that they dissolve or disperse completely in water to produce the beverage. Filtration of the beverage is not necessary, nor is it desirable since the dispersible ingredients may block a filter. Therefore, in these embodiments the gusset strip suitably comprises a zone of weakness that ruptures to provide an opening of effective diameter greater than 1 mm, for example greater than 5 mm, through which the beverage can flow unobstructed. The zone of weakness is suitably a line of weakness, for example a score line or a line of perforations. The line may be a straight line, for example a line extending along the internal fold of the gusset. Or the line could for example be C-shaped or U-shaped to define a flap opening in the gusset.

In other embodiment, the capsule contains an infusible beverage ingredient such as ground coffee or leaf tea. These capsules require a filtration element to retain the ingredient in the capsule during dispensing of the beverage. Thus, in certain embodiments of the present invention, the gusset strip suitably comprises perforations to allow a beverage to escape from the body through the strip in use while substantially retaining an infusible ingredient inside the body.

Suitably, in the perforated gusset embodiments the gusset strip comprises a plastic film having perforations in a central region thereof and a margin that is substantially free of perforations. In this way the perforations do not interfere with bonding of the gusset strip to the front and back sheets. Suitably, the corners of the strip are also substantially free of perforation, so that only a central region of the gusset strip is perforated. For example, the perforated region may be oval or lozenge-shaped. This directs the outflow of beverage to the central region of the outlet and thereby improves liquid flow both within and outside the capsule.

In other embodiments, the perforations may extend into the marginal regions of the gusset strip. This opens a further possibility for making the releasable base seal of the outlet by heat sealing the front and back sheets together through the two long edge margins of the gusset strip. That is to say, the thermoplastic sealing layers on the inside surfaces of the front and back sheets may be bonded together through the perforated gusset strip due to the melted thermoplastic striking through the perforations, thereby resulting in a relatively weak heat seal that can be opened by the action of heat and pressure from inside the capsule body. This enables the whole pack, including the gusset and the releasable seal at the outlet, to be made from a single sheet of material having a thermoplastic sealing layer.

In yet other embodiments, the perforated gusset strip is rendered liquid-impermeable before use by a water-dispersible polymer blocking said perforations. In use, the water-dispersible polymer composition dissolves or disperses to allow liquid through the perforations. The blocking may be achieved simply by filling the perforations with the water-dispersible polymer composition, e.g. with a doctor blade. More suitably, the perforated gusset strip is rendered liquid-impermeable before use by a continuous sheet of the water-dispersible polymer laminated to the gusset strip and covering all of the perforations. Suitably, the sheet of water-dispersible polymer is laminated to the surface of the gusset strip facing the interior of the capsule. The term "laminated" refers to any water-impermeable bonding of the water-dispersible sheet to the gusset strip. An advantage of these embodiments is that the water-dispersible polymer provides the necessary hermetic sealing before use, so that it is no longer necessary to provide the transverse freshness seals in the outlet region as described above, although these seals may also be present to provide additional security. The polymer compositions may contain additional, conventional components such as plasticisers such as glycerol or sorbitol.

The water-dispersible polymer may be any food-acceptable water-dispersible polymer composition. For example, the water dispersible polymer can be selected from the list including, but not limited to, alginates, pullulan, hydrocolloids, ss-glucan, maltodextrin, celluloses, including hydroxypropylmethyl cellulose, hydroxyethyl cellulose, hydroxypropyl cellulose, carboxymethyl cellulose, methylcellulose, hydroxymethylcellulose, hydroxyethylcellulose, polyvinyl pyrrolidone, polyvinyl alcohol, polyethylene glycol, hydroxypropyl ethyl cellulose, cellulose acetate phthalate, hydroxypropyl methyl cellulose phthalate, natural gums, such as locust bean gum, carrageenan gum, xanthan gum, tragacanth gum, guar gum, acacia gum, arabic gum, karaya, ghatti, tamarind gum, polyacrylic acid, methylmethacrylate copolymer, carboxyvinyl polymer, amylose, high amylose starch, hydroxypropylated high amylose starch, dextrin, pectin, chitin, chitosan, levan, elsinan, collagen, gelatin, zein, gluten, soy protein isolate, whey protein isolate, casein, and mixtures thereof. The edible polymer may alternatively or additionally include water dispersible synthetic polymers, copolymers, block polymers, including, but not limited to, poly (glycolic acid) (PGA), poly (lactic acid) (PLA), polydioxanoes, polyoxalates, poly (alpha-esters), polyanhydrides, polyacetates, polycaprolactones, poly (orthoesters), polyamino acids, polyaminocarbonates, polyurethanes, polycarbonates, polyamides, poly (alkyl cyanoacrylates), stereopolymers of L- and D-lactic acid, copolymers of bis (p-carboxyphenoxy) propane acid and sebacic acid, sebacic acid copolymers, copolymers of caprolactone, poly (lactic acid)/poly (glycolic acid)/polyethyleneglycol copolymers, copolymers of polyurethane and poly (lactic acid), copolymers of polyurethane and poly (lactic acid), copolymers of .alpha.-amino acids, copolymers of .alpha.-amino acids and caproic acid, copolymers of .alpha.-benzyl glutamate and polyethylene glycol, copolymers of succinate and poly (glycols), polyphosphazene, polyhydroxy-alkanoates, and any combinations thereof. An example of a suitable blocking polymer composition is a hot water soluble film comprising polyvinyl alcohol (PVOH) such as those available from Monosol Ltd. of Hartlebury, UK.

As already noted, a layer of nonwoven textile filtration material may be provided, abutting or laminated to the gusset strip on an upstream surface thereof. This allows the perforations in the gusset strip to be made big enough for the desired flow rate of beverage, while maintaining effective filtration of small particulates. Since the nonwoven textile filtration material is supported on the gusset strip the mechanical weakness of the nonwoven textile filtration material is not an issue and it can be made very thin.

Suitably, the perforations in the gusset sheet have an effective diameter of from about 50 to about 500 μm, for example from about 100 to about 250 μm. Suitably, the perforations have an average effective density of from about 25 to about 250 perforations/$cm^2$. Suitably, the perforated area of the strip is at least about 1 $cm^2$, for example from about 1 $cm^2$ to about 4 $cm^2$.

Suitably, the perforations are substantially round. Suitably there are at least about 10 perforations, for example from about 20 to about 1000 perforations, more suitably from about 50 to about 250 perforations. The perforations may be formed in the strip by any means, for example laser perforation, mechanical perforation, hot needle perforation, or vacuum perforation.

In the embodiment where the gusset strip has perforations, the gusset strip preferably allows the beverage to pass through the strip after opening of the capsule, but retains the beverage preparation ingredient inside the capsule. In this way, the use of the gusset strip in the bottom of the capsule replaces the filter web that is used in existing FLAVIA filter capsules. Suitably, the capsules according to the present invention do not comprise any filtration element for the beverage other than the gusset strip (including any filter sheet laminated thereto). Elimination of the separate filter element simplifies the manufacture of the capsules according to the present invention. In addition, because the gusset is bonded into the bottom edge of the capsule, the total volume inside the capsule available for storage of the beverage ingredient is increased thereby reducing the amount of material required to form the capsule for a given amount of beverage ingredient. Finally, the gusset helps to maintain rigidity of the capsule during beverage preparation, thereby allowing thinner materials and narrower edge sealing margins to be used for the capsule.

In certain embodiments, diagonal lines of bonding are formed between the gusset strip and the adjacent front or back sheets of flexible film material, said diagonal lines of bonding extending across at least one and preferably each of the four corners of the gusset strip. The diagonal lines of bonding exclude liquid from the corners of the capsule adjacent to the corners of the gusset strip and act to funnel the beverage towards the centre of the gusset so that it flows smoothly from the centre of the outlet region. Suitably, the diagonal lines of bonding intersect the side edge and the bottom edge of the capsule at angles of from about 30 degrees to about 60 degrees, suitably about 45 degrees.

Suitably, the capsule is a single-serve capsule that contains sufficient beverage preparation ingredients for the preparation of a single portion of beverage, i.e. from about 25 to about 500 ml, preferably from about 100 ml to about 250 ml of beverage. For example, the capsule may contain from about 2 g to about 25 g of ground coffee or from about 1 g to about 9 g of leaf tea, or from about 2 g to about 30 g of water dispersible ingredients.

The sheet materials used to form the body of the capsule and/or the gusset sheet may suitably consist essentially of flexible film materials, for example of the type used to form existing FLAVIA capsules. The sheet or flexible film material will usually be a laminate comprising two or more of the following layers: a thermoplastic sealant layer for bonding the sheet to other members of the package; a substantially gas-impermeable barrier layer, which may be a metal film such as aluminum film or a gas-barrier polymer such as polyvinyl alcohol (PvOH); adhesion layers to improve adhesion between other layers of the laminate; structural layers, for example to provide puncture resistance; and/or a printing substrate layer. The structural layers could be made of polyolefins, polyester, nylons, or other polymers as is well known in the art. In one embodiment, the sheet material is a laminate comprising a layer of polypropylene and a layer of polyvinyl alcohol (PvOH). The sheet materials may comprise at least a transparent region to provide visibility of the contents of the capsule.

In certain embodiments, the capsule body may be formed from a single sheet in the form of a tube having said outlet region at one end thereof. The tube may be formed by extrusion, or it may be formed from a single sheet by folding the sheet over and bonding opposed edges thereof along a longitudinal lap or fin seal.

In alternative embodiments, the body may be formed by permanently bonding together first and second sheets of said materials in face-to-face relationship around the margins thereof apart from the outlet region.

The gusset strip may be a separate V-folded strip of sheet material (or laminate thereof with a nonwoven filter layer) that is inserted into the open end of the capsule body and bonded to the open edges of the capsule body by thermal or adhesive bonding in conventional fashion. Continuous methods of manufacturing such gusset packs are well known in the art, for example to manufacture "stand-up" pouches for confectionery and pet food, and will not be discussed further.

In other embodiments, the gusset strip is formed integrally with the front and back sheets, by folding. That is to say, a single sheet of material is folded into a W-fold such that the outer limbs of the W form the front and back faces of the capsule and the central limbs of the W form the gusset. The gusset region of this sheet may be processed to form the perforations or the zone of weakness before folding, by any of the methods described above. Alternatively, the W-fold may be opened out to an inverted T-cross section in order to introduce the perforations or zone of weakness after manufacture of the capsule body. In any event, the formation of the gusset integrally with the front and back faces by folding provides advantages in terms of integrity of the pack, and simplicity of materials and manufacture.

In certain embodiments, the beverage preparation capsule further comprises a liquid injection nozzle bonded to the capsule body and having a bore through which liquid can be injected to prepare a beverage in said capsule, said bore being sealed by a frangible freshness barrier before use. For example, the freshness barrier may comprise an oxygenimpermeable membrane of metal foil and/or thermoplastic film extending across the bore of the nozzle.

In certain embodiments, the body comprises two flexible laminate sheets in face-to-face relationship and permanently bonded together along edge seams and a top seam with said outlet region being provided in a bottom seam of said body, and wherein said liquid injection nozzle is inserted into the top seam or an edge seam of the capsule body. In these embodiments, the construction of the capsule is substantially the same as for a conventional FLAVIA capsule as described above, but with addition of the gusset strip and without the internal filter sheet.

In a further aspect, the present invention provides a method of preparing a beverage, comprising the step of passing an aqueous liquid through a beverage preparation capsule according to the present invention. The aqueous liquid is preferably water, for example at a temperature of 85° C. to 99° C. The method may be performed in the beverage preparation apparatus already known for use with existing capsule formats, for example as described in the patent references listed above, without modification of the apparatus. The water may suitably be injected at a pressure of 0.5 to 1.5 bar gauge for filter-type coffee, and at higher pressures such as 5-20 bar gauge for espresso-type coffee, depending on the system. It is a further advantage of the capsules of the invention that they can withstand higher internal pressures since the gusset filter is made of stronger material than the nonwoven web filters of the prior art, and moreover the plastic sheet material of the gusset is not weakened by water or acid in the same way as a nonwoven web filter.

BRIEF DESCRIPTION OF THE DRAWINGS

An embodiment of the present invention will now be described further, by way of example, with reference to the accompanying drawings, in which.

DETAILED DESCRIPTION

Figure 3:
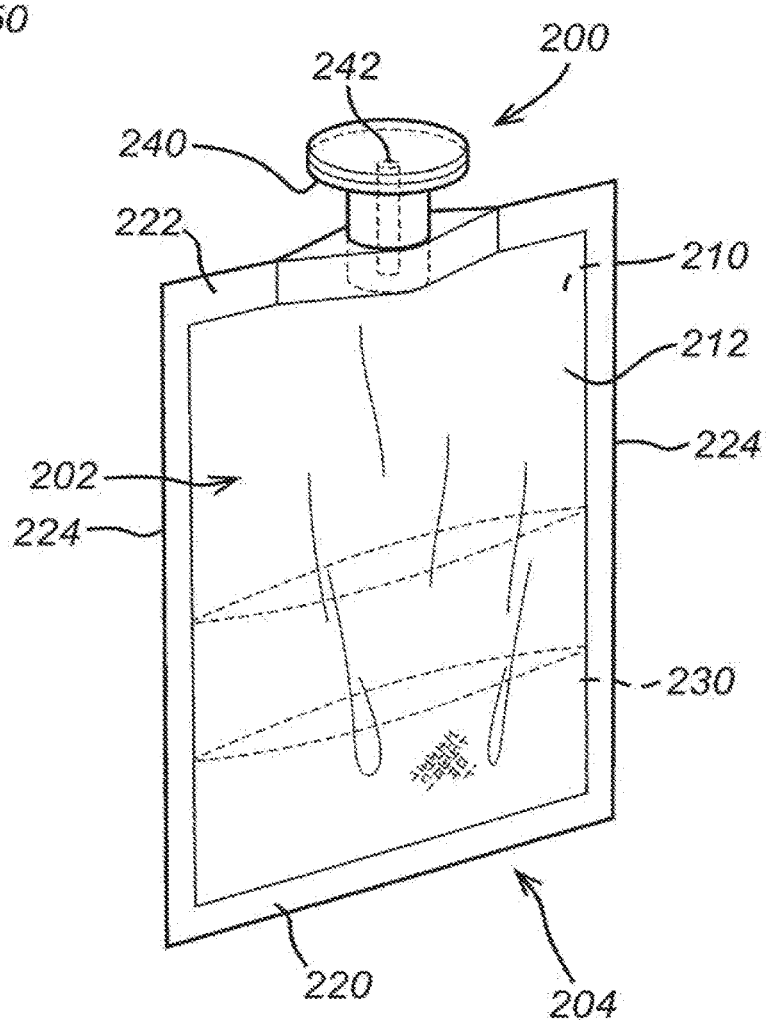
FIG. 3 shows a perspective view of a beverage preparation capsule according to the present invention.
Figure 4:
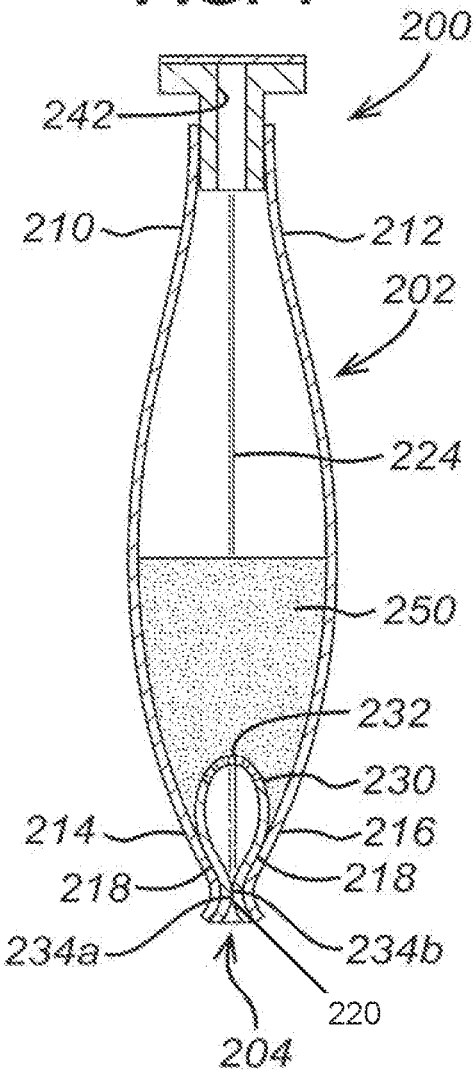
FIG. 4 shows a cross-sectional view of a beverage preparation capsule of FIG. 3.

FIG. 3 and FIG. 4 respectively show perspective and cross-sectional views of a sealed beverage preparation capsule according to the present invention. The beverage preparation capsule 200 contains an infusible beverage preparation ingredient 250 such as ground coffee or leaf tea. The beverage preparation capsule 200 has a body 202 which comprises side walls 210, 212 and a gusset sheet material 230.

The side walls 210, 212 may be formed from one or more substantially air- and liquid-impermeable sheet materials. The sheet materials may consist essentially of flexible film materials. The gusset sheet material 230 may have a central region 232 provided with a plurality of perforations for filtering the infusible beverage preparation ingredient 250 in use.

An outlet region 204 of the beverage preparation capsule 200 is formed from front and back sheet materials 214, 216 arranged in face-to-face relationship along an edge 218 and the gusset sheet material 230 inserted between the front and back sheet materials 214, 216 and bonded thereto along the edge 218.

Surfaces 234 *a*, 234 *b* of the gusset sheet material 230 opposite the front and back sheets 214, 216 are bonded together to complete a substantially airtight seal in the outlet region 204. The bonding between the surfaces 234 *a*, 234 *b* of the gusset sheet material 230 may comprise a pressure-sensitive or heat-sensitive adhesive. The bonding may be released by elevated temperature and/or pressure inside the capsule body 202 to allow a beverage to escape from the body 202 through the perforations in the gusset sheet 230 in use.

The beverage preparation capsule 200 may further comprise a liquid injection nozzle 240 bonded to the capsule body 202. The liquid injection nozzle 240 may have a bore 242 through which liquid can be injected into the capsule to prepare a beverage. The bore 242 may be sealed by a frangible freshness barrier before use. Of course, the beverage preparation capsule may have other suitable liquid injection mechanisms for injecting liquid into the capsule to prepare a beverage.

Figure 5:
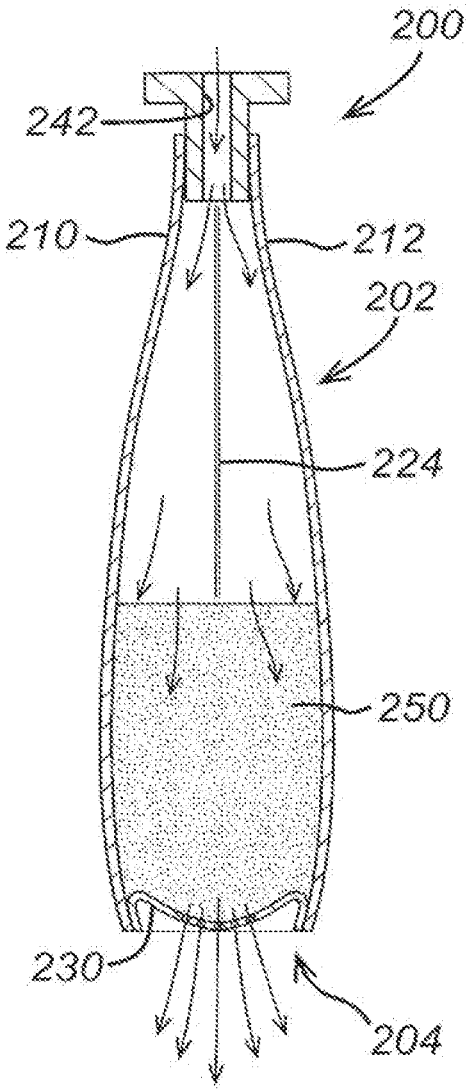
FIG. 5 shows a cross-sectional view of a beverage preparation capsule of FIGS. 3 and 4 when the beverage preparation capsule is in use.

In use, liquid is introduced into the beverage preparation capsule 200 through the bore 242 of the liquid injection nozzle 240. Upon introduction of the liquid into the capsule, the gusset sheet material 230 will evert downwardly to form a bed for the beverage preparation. The bottom seam 220 will open under the heat and/or liquid/air pressure. The infusible beverage preparation ingredient 250 will be infused with the liquid within the capsule. The infused solids will be retained by the gusset sheet material 230. The beverage flowing through the perforations of the central portion 232 of the gusset sheet material 230 will be dispensed through the bottom opening. FIG. 5 shows a cross-sectional view of the beverage preparation capsule in use.

The gusset sheet material 230 shown in FIGS. 3 and 4 has a substantially inverted V shape before use and thus everts downwardly in use. However, it should be understood that the gusset sheet material may also be formed in other suitable shapes and thus may not need to evert in use.

The capsule body 202 may be formed from a single sheet of the materials in the form of a tube having the outlet region 204 at a bottom end. The tube may be formed from the single sheet of the materials by folding the sheet over and bonding opposed edges along a longitudinal lap or fin seal.

The capsule body 202 may be formed by bonding together first and second sheets of the materials in face-to-face relationship around the margins thereof apart from the outlet region 204. For example, the capsule body 202 may comprise two flexible laminate sheets in face-to-face relationship and bonded together along side seams 224 and a top seam 222 with said outlet region 204 being provided in a bottom seam 220 of the capsule body 202. The liquid injection nozzle 240 may be inserted into the top seam 222 or a side seam 224 of the capsule body 202.

The gusset sheet material 230 may comprise a plastic film having perforations at least in a central region 232. An advantage of using plastic films is that plastic materials are generally more durable than the conventionally used filtering papers. The beverage preparation capsules formed with plastic films are therefore less likely to burst during brewing than the capsules formed with filtering papers.

The gusset sheet material may be formed by laser perforation. Laser perforation has been increasingly used in the package manufacturing industry. It typically comprises a laser source to generate laser beams and a focusing mechanism, e.g. mirrors, to focus and direct the laser beams to make perforations. Laser perforation offers flexible and precise perforation sizes and patterns than other perforation methods.

Figure 1:
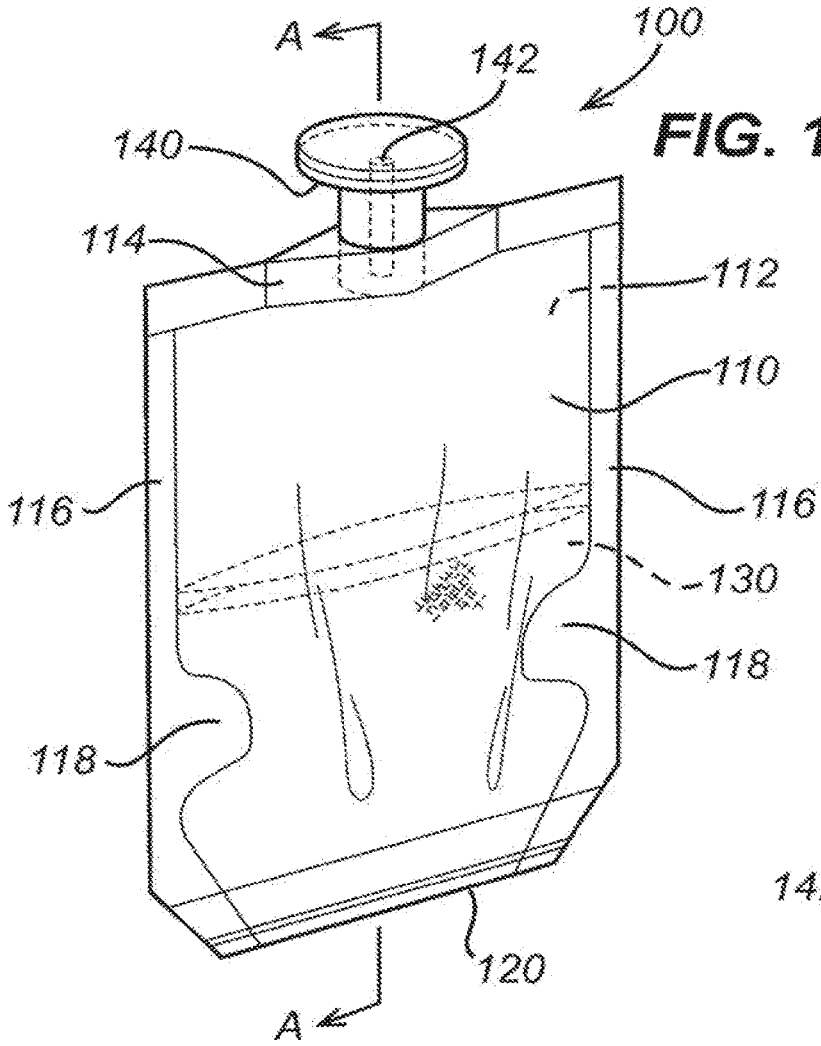
FIG. 1 (Prior art)
FIG. 1 shows a perspective view of a beverage preparation capsule according to the prior art.

For the beverage preparation packages of the present application, laser perforation allows the gusset sheet 230 to be formed with desired perforation sizes. It also allows the gusset sheet 230 to be formed with a desired pattern for preparing various beverage preparation ingredients. For example, the gusset sheet material 230 may be formed to have a perforated central region 232 for filtering the infusible beverage preparation ingredient 250 and an imperforated and relatively harder margin region where the gusset sheet material 230 is bonded to the front and back sheets 214, 216. In this manner, the margin region of the gusset sheet material 230 may have similar mechanical characters to the front and back sheets 214, 216. The bottom seam 220 of the capsule may maintain a substantially regular opening during the dispensing of the beverage. This can remove the requirements of forming the capsule into a waist shape and forming the filter material into a V or W (as shown in FIG. 1) to overcome the irregular opening problems associated with the conventional beverage preparation capsules. Further, the cost of manufacturing can be reduced and the space sealed inside the beverage preparation capsule can be fully used for beverage preparation.

Figure 2A:
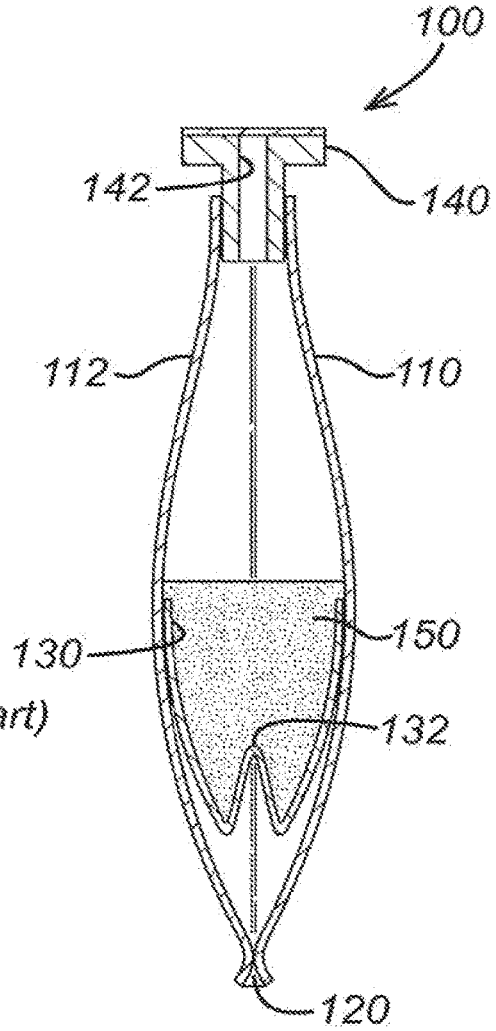
FIG. 2a (Prior art)
FIGS. 2 *a* and 2 *b* show cross-sectional views of the beverage preparation capsule of FIG. 1 before and in use respectively.
Figure 2B:
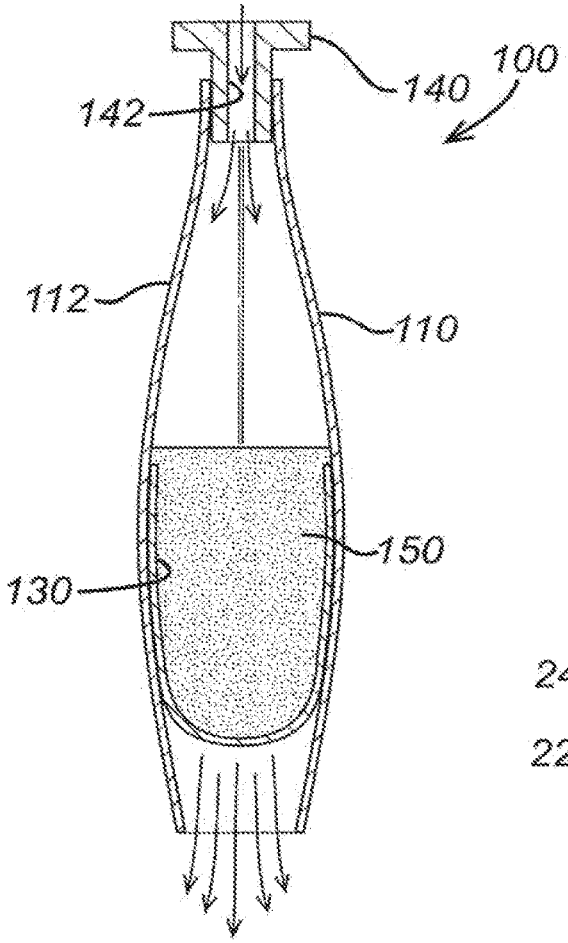
FIG. 2b (Prior art)

As described above and shown in FIGS. 2 *a* and 2 *b*, the conventional beverage preparation capsules 110 are typically sealed at the bottom seam 120 before use. The filtration material is attached to the side walls 110, 112 over a middle or low-middle region of the capsule body and at least above the bottom seam 120. Advantageously, the beverage preparation capsule 200 according to the present invention has a gusset sheet material 230 bonded to the front and back sheet materials 214, 216 to form the outlet region 204. The opposite surfaces 234 *a*, 234 *b* of the gusset sheet material 230 are bonded to one another, e.g. by pressure-sensitive adhesive, to complete a substantially airtight seal in the outlet region 204. The available space within the capsule body for accommodating and brewing the beverage preparation ingredient is thus increased.

Furthermore, the gusset strip retains the capsule in a tubular configuration with straight sides both before and during beverage brewing, thereby removing the need for lands in the side seals. This increases the capacity of the capsule for a given amount of sheet material, and simplifies the manufacturing process.

Figure 6:
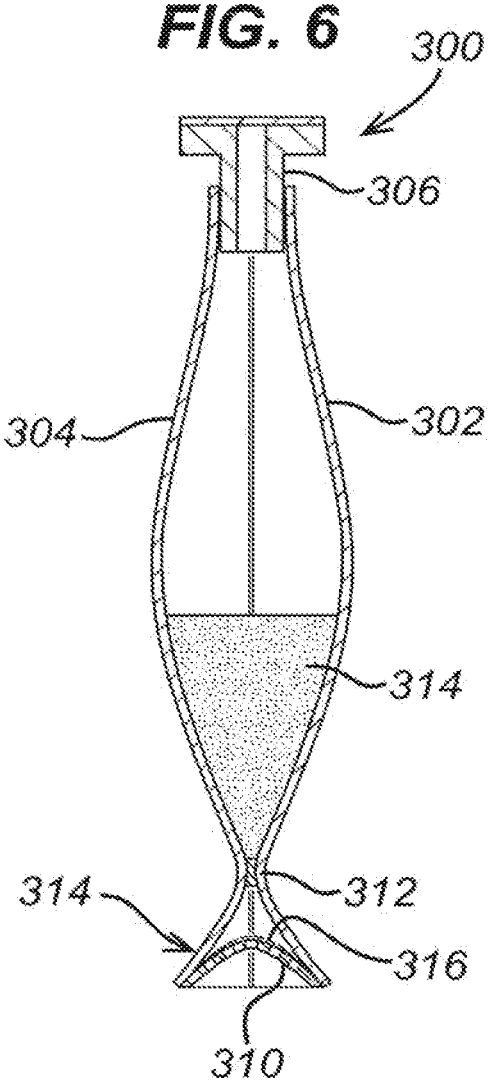
FIG. 6 shows a cross-sectional view of a beverage preparation capsule according to a second embodiment of the invention.
Figure 7:
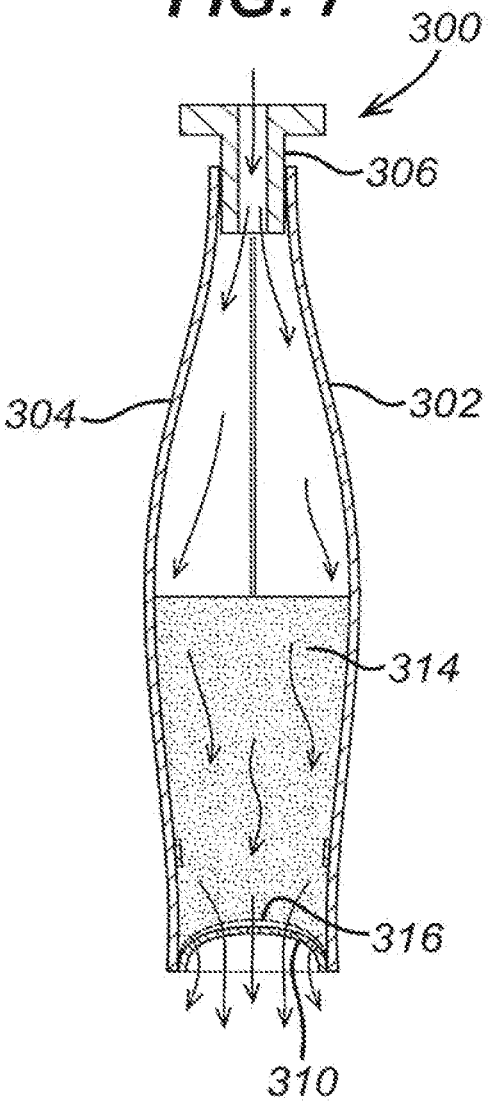
FIG. 7 shows a cross-sectional view of a beverage preparation capsule of FIG. 6 when the beverage preparation capsule is in use.
Figure 8:
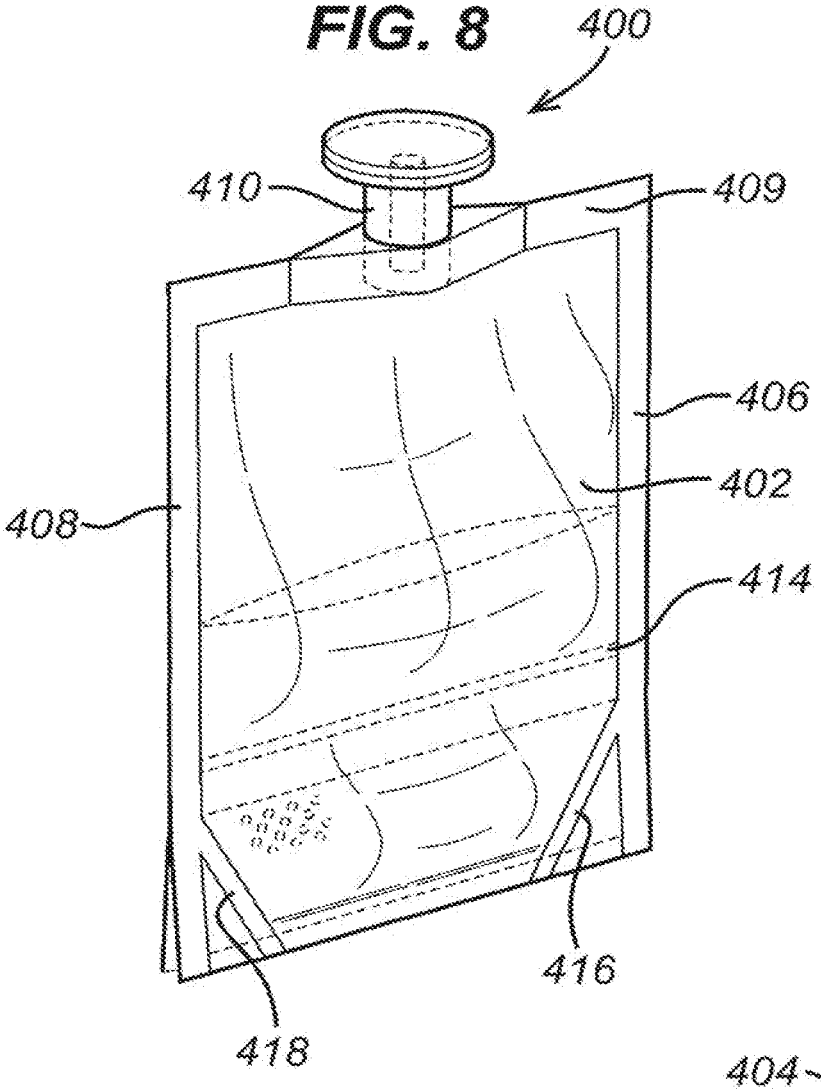
FIG. 8 shows a perspective view of a beverage preparation capsule according to a third embodiment of the invention.
Figure 9:
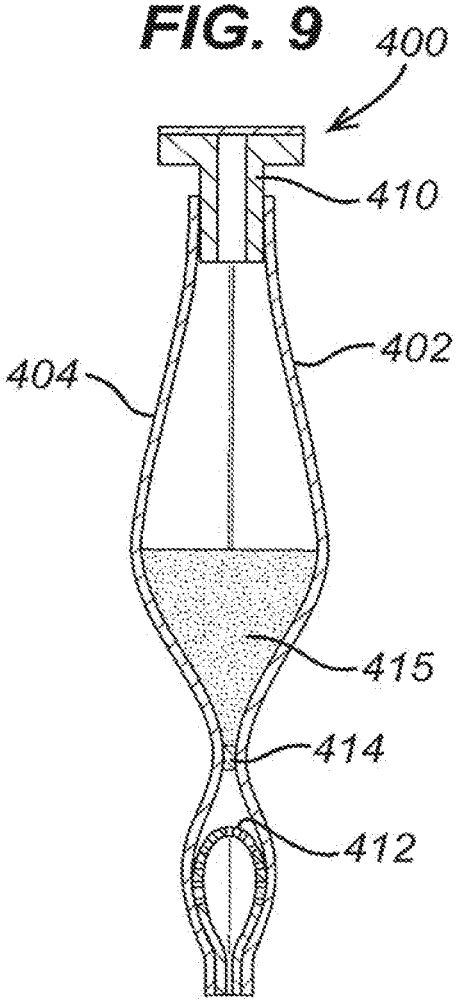
FIG. 9 shows a cross-sectional view of a beverage preparation capsule of FIG. 8.
Figure 10:
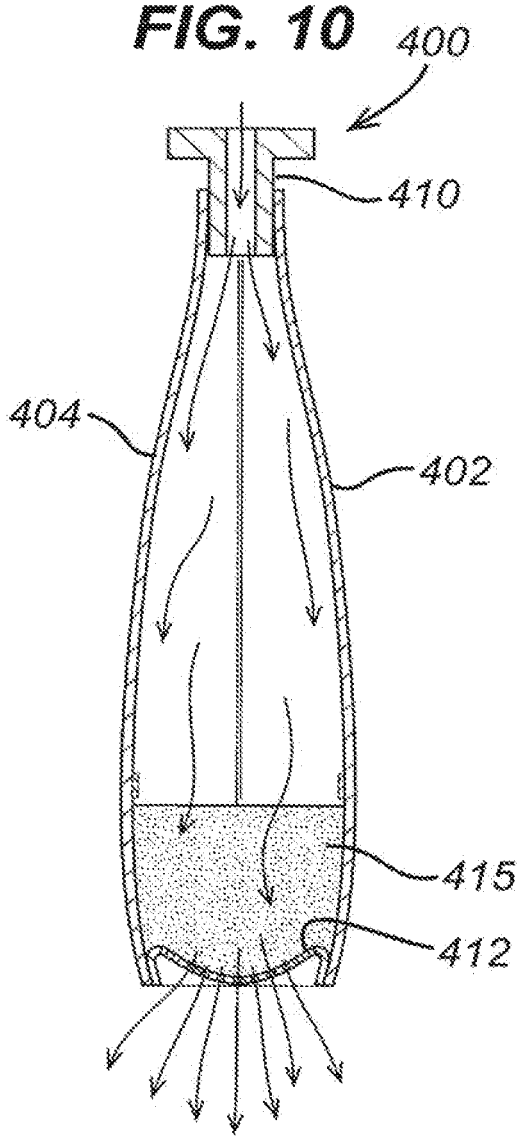
FIG. 10 shows a cross-sectional view of a beverage preparation capsule of FIG. 8 when the beverage preparation capsule is in use.
Figure 11:
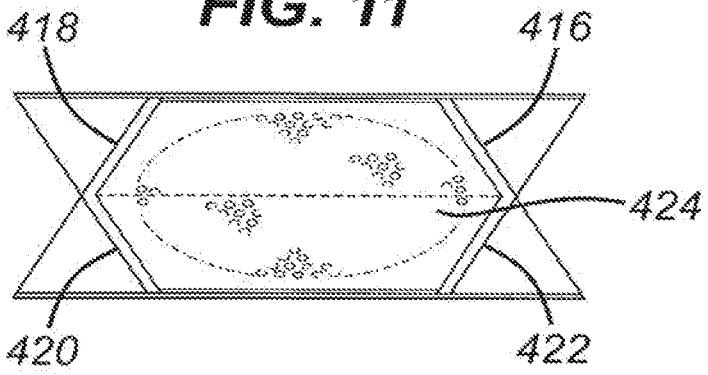
FIG. 11 shows a bottom plan view of a beverage preparation capsule of FIG. 8 when the beverage preparation capsule is in use.

FIGS. 6 and 7 show an alternative embodiment of the present invention. In this embodiment, the construction of the capsule 300 is broadly similar to that of FIGS. 1-5. The capsule comprises front and back sheets 302,304 bonded together along top and side edges as previously described. A nozzle 306 is inserted between the front and back sheets in the top edge. A perforated gusset sheet 310 is bonded to the bottom edges of the front and back sheets 302,304 as described for FIGS. 3-5. A beverage preparation ingredient is enclosed within the capsule 300. In this embodiment, the hermetic outlet seal is formed by a line of pressure sensitive adhesive 312 extending across the capsule to bond the front and back sheets together and located above the gusset strip. A thin nonwoven web (scrim) of fibrous filter material 316, for example a polypropylene scrim, is laminated to the inside surface of the gusset strip 310.

In use, hot water is injected into the capsule through nozzle 306 to prepare the beverage inside the capsule. The heat and pressure of the water (optionally assisted by an external heat source in the beverage making apparatus) releases the adhesive bond 312 and allows the beverage to escape through the filter scrim 316 and the perforated gusset 310. The scrim 316 allows the perforations in the gusset strip to be made larger, e.g. about 150 micrometers or more, to allow a high flow rate of the beverage while still effectively filtering the beverage.

FIGS. 8 to 11 show an alternative embodiment of the present invention. In this embodiment, the construction of the capsule 400 is broadly similar to that of FIGS. 6 and 7. The capsule comprises front and back sheets 402,404 bonded together along top 409 and side 406,408 edges as previously described. A nozzle 410 is inserted between the front and back sheets in the top edge 409. A perforated gusset sheet 412 is bonded to the bottom edges of the front and back sheets 402,404 as described above. The gusset strip has perforations in a central region 424 only. A beverage preparation ingredient 415 is enclosed within the capsule 400. In this embodiment, the hermetic outlet seal is formed by a line of pressure sensitive adhesive 414 extending across the capsule to bond the front and back sheets together and located above the gusset strip. A thin nonwoven web (scrim) of fibrous filter material (not shown), for example a polypropylene scrim, may be laminated to the inside surface of the gusset strip 412.

This embodiment is further characterized by diagonal lines of bonding 416,418,420,422 between the gusset sheet and the adjacent front and back sheets of the capsule. The diagonal lines of bonding extend across the bottom corners of the capsule to exclude liquid from these corners.

In use, hot water is injected into the capsule through nozzle 410 to prepare the beverage inside the capsule. The heat and pressure of the water (optionally assisted by an external heat source in the beverage making apparatus)

releases the adhesive bond 414 and allows the beverage to escape through the perforated gusset 412. The diagonal lines of bonding provide a funnel-like configuration at the bottom of the capsule that directs flow of liquid through and out of the capsule. The diagonal lines of bonding also help to maintain a stable shape of the capsule during beverage preparation.

Figure 12:
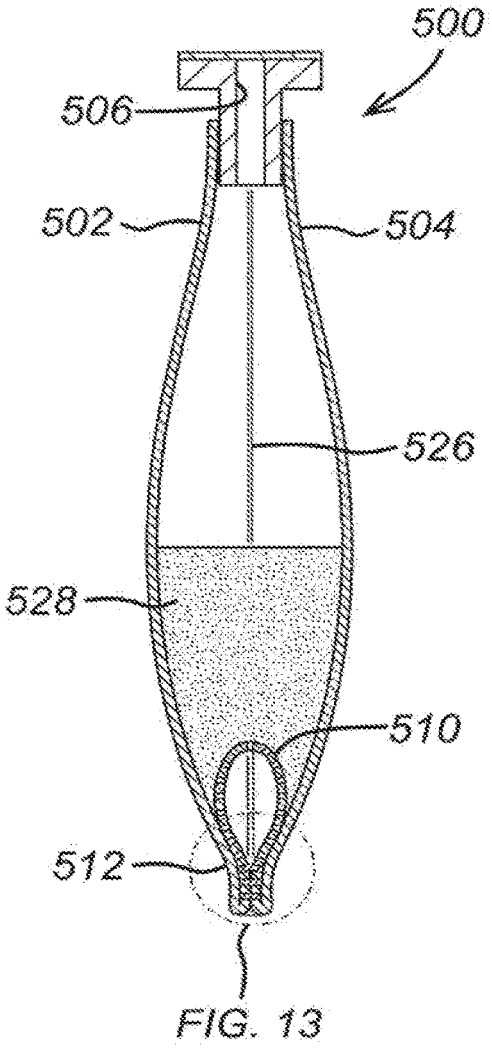
FIG. 12 shows a cross-sectional view of a beverage preparation capsule according to a fourth embodiment of the invention.
Figure 13:
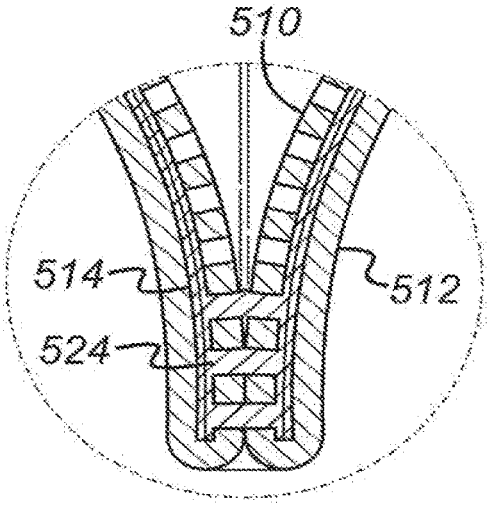
FIG. 13 shows a detailed cross-sectional view of the outlet region of the beverage preparation capsule of FIG. 12.

FIGS. 12 and 13 show an alternative embodiment of the present invention. In this embodiment, the construction of the capsule 500 is broadly similar to that of FIGS. 1-5. The capsule comprises front and back sheets 502,504 bonded together along top and side edges as previously described. A nozzle 506 is inserted between the front and back sheets in the top edge. An infusible beverage preparation ingredient 528 is enclosed within the capsule 500.

In this embodiment perforated gusset strip 510 is formed integrally with the front and back sheets 502,504 by forming a W-fold in the bottom edge of the capsule. Thus, the perforated gusset strip 510 is formed of exactly the same sheet material as the front and back sheets. The gusset strip region of the sheet is perforated over its whole area with laser perforations having diameter about 200 μm in a rectangular array of pitch about 1 mm prior to folding the sheet to form the capsule.

As shown in FIG. 13, the sheet material is a laminate comprising one or more structural layers 512 and an internal sealing layer 514 of a thermoplastic polymer such as a polyolefin having a suitable melting temperature range for heat sealing and release. The side edge seals 526 and top edge seals of the capsule are formed by conventional melt bonding of this sealing layer. A weaker sealing bond 524 is formed at the bottom of the folded gusset, also by heat sealing or ultrasonic sealing. The sealing process melts the internal sealing layer 514 so that it flows through the perforations in the structural layer to fuse with the sealing thermoplastic that has leaked from the perforations on the opposite side of the gusset. This results in a relatively weak heat seal along the sealing bond 514 that can be released by the action of heat and pressure from inside the capsule during beverage preparation.

In use, hot water is injected into the capsule through nozzle 506 to prepare the beverage inside the capsule. The heat and pressure of the water (optionally assisted by an external heat source in the beverage making apparatus) releases the weak thermal bond 524 and allows the beverage to escape through the perforated gusset region 510.

Figure 14:
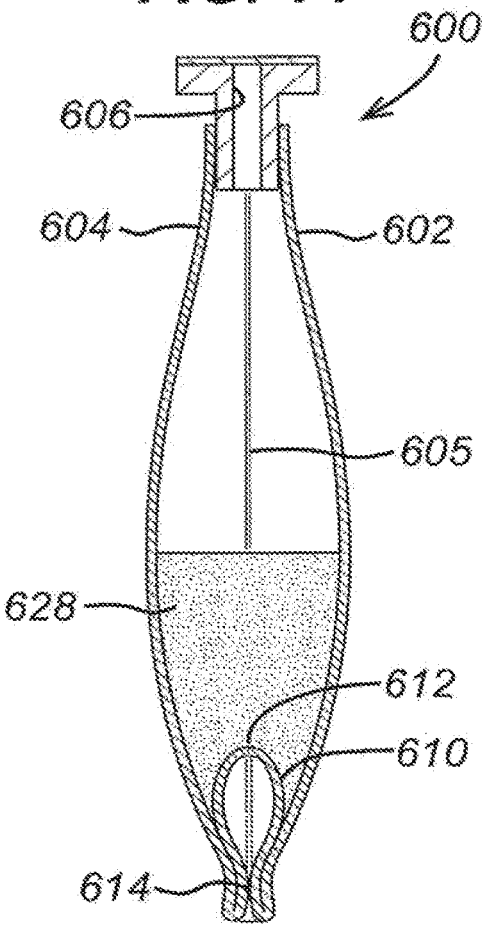
FIG. 14 shows a cross-sectional view of a beverage preparation capsule according to a fifth embodiment of the invention.
Figure 15:
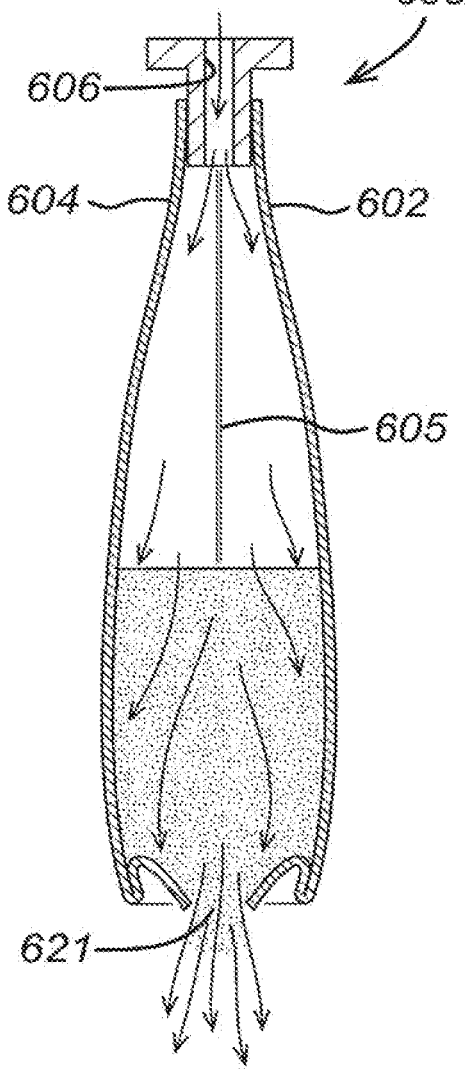
FIG. 15 shows a cross-sectional view of a beverage preparation capsule of FIG. 14 when the beverage preparation capsule is in use.

FIGS. 14 and 15 show an alternative embodiment of the present invention intended in particular for water-soluble or water-dispersible ingredients such as instant coffee, instant tea, liquid or solid concentrates of milk, chocolate, soup, or fruit-flavoured drinks. These ingredients normally do not require filtration during dispensing. In this embodiment, the construction of the capsule 600 is broadly similar to that of FIGS. 12 and 13. The capsule comprises front and back sheets 602,604 bonded together along top edge and side edges 605 as previously described. A nozzle 606 is inserted between the front and back sheets in the top edge. A water-soluble or water-dispersible beverage preparation ingredient 628 is enclosed within the capsule 600.

In this embodiment gusset strip 610 is formed integrally with the front and back sheets 602,604 by forming a W-fold in the bottom edge of the capsule. Thus, the perforated gusset strip 610 and the front and back sheets are formed from a single sheet of material. The gusset strip region of the sheet is not perforated. Instead, a score line of weakness 612 extends along the internal fold of the gusset for a distance of 1-2 cm. A releasable adhesive bond 614 is applied along the bottom of the gusset to ensure hermetic sealing of the pack before use.

In use, as shown in FIG. 15, hot water is injected into the capsule through nozzle 606 to mix with the beverage ingredient inside the capsule. The heat and pressure of the water (optionally assisted by an external heat source in the beverage making apparatus) releases the weak thermal bond 614 and ruptures the line of weakness to create an opening 621 allows the beverage to escape from the capsule.

Figure 16:
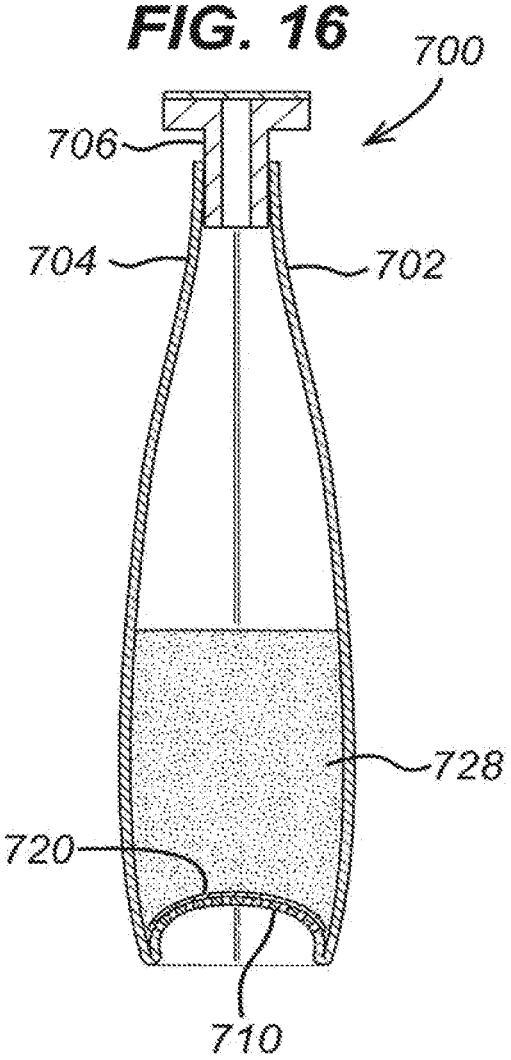
FIG. 16 shows a cross-sectional view of a beverage preparation capsule according to a sixth embodiment of the invention.

FIG. 16 shows an alternative embodiment of the present invention intended in particular for infusible ingredients that require filtration, such as ground coffee or leaf tea. The construction of the capsule 700 is broadly similar to that of FIGS. 6 and 7. The capsule comprises front and back sheets 702,704 bonded together along top edge and side edges as previously described. A nozzle 706 is inserted between the front and back sheets in the top edge. A water-infusible beverage preparation ingredient 728 is enclosed within the capsule 700.

In this embodiment gusset strip 710 is formed integrally with the front and back sheets 702,704 by forming a W-fold in the bottom edge of the capsule. Thus, the perforated gusset strip 710 and the front and back sheets are formed from a single sheet of material.

A layer 720 of water-soluble polymer composition is laminated to the inside surface of the gusset 710 to cover and seal the perforations before use. The polymer composition comprises hot-water-soluble PVOH, optionally with added polysaccharides. Since the layer 720 of water-dispersible polymer composition hermetically seals the perforations of the gusset strip 710 before use, no releasable adhesive bond is needed in the outlet region. This simplifies the manufacture of the capsules. The water-dispersible polymer composition can simply be applied to the perforated region of the film before it is folded up and sealed to make the capsule.

In use, hot water is injected into the capsule through nozzle 706 to mix with the beverage ingredient inside the capsule. The hot water also dissolves the polymer layer 720 to allow the beverage to escape from the capsule through the perforations. The polymer layer is made of edible materials that are dispersed in the product drink.

It should be understood that the above embodiments have been described by way of example only. Many other embodiments falling within the scope of the accompanying claims will be apparent to the skilled reader. It will further be understood that any feature disclosed in relation to any one embodiment may alternatively or additionally be present in any of the other embodiments.

What is claimed is:

1. A beverage preparation capsule comprising:

a capsule body comprising a cavity containing a beverage preparation ingredient, the capsule body comprising:

a front sheet of flexible film material having an inner surface and a lower edge and a back sheet of flexible film material having an inner surface and a lower edge, the inner surface of the front sheet facing the inner surface of the back sheet; and a strip of flexible material separate and distinct from the front and back sheets, the strip of flexible material being coupled to the inner surfaces of the front and back sheets at a location that is adjacent to the lower edges of the front and back sheets, wherein the strip of flexible material is bonded to itself to form a seal in an outlet region of the capsule body;

wherein the strip of flexible material, prior to introduction of a liquid into the capsule body, extends inwardly from the inner surfaces of the front and back sheets to form a rounded portion of the strip of flexible material; and wherein the front and back sheets are not directly bonded to one another along the outlet region of the capsule body.

2. The beverage preparation capsule according to claim 1 further comprising at least one perforation located along the rounded portion of the strip of flexible material, the at least one perforation forming an opening through the strip of flexible material prior to introduction of the liquid into the capsule body.

3. The beverage preparation capsule according to claim 1 wherein the strip of flexible material comprises an inner surface and an outer surface, a first portion of the outer surface of the strip of flexible material being bonded to the inner surface of the front sheet, a second portion of the outer surface of the strip of flexible material being bonded to the inner surface of the back sheet, and a first portion of the inner surface of the strip of flexible material being bonded to a second portion of the inner surface of the strip of flexible material to form the seal in the outlet region of the capsule body.

4. The beverage preparation capsule according to claim 3 wherein the strip of flexible material comprises a first edge and a second edge, the first edge being located adjacent to the lower edge of the front sheet and the second edge being located adjacent to the lower edge of the back sheet, and wherein the first and second portions of the inner surface of the strip of flexible material are located between the first and second edges of the strip of flexible material and the rounded portion of the strip of flexible material.

5. The beverage preparation capsule according to claim 3 wherein, upon introduction of the liquid into the cavity of the capsule body, the rounded portion of the strip of flexible film material everts downwardly and the seal in the outlet region of the capsule body opens.

6. The beverage preparation capsule according to claim 5 wherein upon the rounded portion of the strip of flexible film material everting downwardly, the outer surface of the strip of flexible material forms a concave surface that faces away from the outlet region, the beverage preparation ingredient sitting atop of the concave surface.

7. The beverage preparation capsule according to claim 1 wherein the strip of flexible film material comprises a lower portion that extends between the seal and the lower edges of the front and back sheets of flexible film material.

8. The beverage preparation capsule according to claim 1 further comprising a layer of nonwoven textile filtration material abutting or laminated to the strip of flexible material on an upstream surface thereof.

9. The beverage preparation capsule according to claim 1 wherein the capsule body comprises a longitudinal axis and the strip of flexible material comprises an inner surface that faces away from the inner surfaces of the front and back sheets, a first portion of the inner surface of the strip of flexible material located on a first side of the longitudinal axis being bonded to a second portion of the inner surface of the strip of flexible material located on a second side of the longitudinal axis to form a bottom seam of the capsule body, and wherein an upper portion of the strip of flexible material is located between the bottom seam and a top end of the capsule body and a lower portion of the strip of flexible material is located between the bottom seam and a bottom end of the capsule body.

10. A beverage preparation capsule having a beverage preparation ingredient sealed therein, the beverage preparation capsule comprising:

front and back sheets of flexible film material having inner surfaces that face one another, the front and back sheets comprising top edges and side edges that are at least partially bonded together;

a gusset sheet formed from a flexible film material having an outer surface, an inner surface, a margin region, and a central region, the outer surface of the gusset sheet along the margin region coupled to inner surfaces of the front and back sheets at bottom ends of the front and back sheets;

wherein the inner surface of the gusset sheet located along the margin region is bonded to itself to form a seal in an outlet region of the beverage preparation capsule;

wherein the central region of the gusset sheet is provided with a plurality of perforations or a zone of weakness;

wherein the beverage preparation ingredient is supported by the outer surface of the gusset sheet; and wherein the seal in the outlet region is configured to be broken during beverage preparation to allow escape of a beverage through the outlet region.

11. The beverage preparation capsule according to claim 10, wherein the gusset sheet is separate and distinct from the front and hack sheets.

12. The beverage preparation capsule according to claim 10 wherein the seal in the outlet region is provided by a pressure sensitive or heat sensitive adhesive.

13. The beverage preparation capsule according to claim 10 wherein the seal in the outlet region is configured to be broken by releasing the bond of the gusset sheet to itself by elevated temperature and/or pressure inside the beverage preparation capsule to allow the beverage to escape from the beverage preparation capsule through the plurality of perforations in the gusset sheet, wherein the gusset sheet allows the beverage to pass through the plurality of perforations in the gusset sheet after the seal is broken while retaining the beverage preparation ingredient inside the beverage preparation capsule.

14. The beverage preparation capsule according to claim 10 wherein the margin region of the gusset sheet is free of perforations.

15. The beverage preparation capsule according to claim 10 further comprising a liquid injection nozzle bonded to the front and back sheets, the liquid injection nozzle comprising a bore through which liquid can be injected to prepare the beverage in the beverage preparation capsule.

16. A beverage preparation capsule comprising:

a capsule body comprising a cavity containing a beverage preparation ingredient, the capsule body comprising:

a front sheet of flexible film material having an inner surface and a lower edge and a back sheet of flexible film material having an inner surface and a lower edge, the inner surface of the front sheet facing the inner surface of the back sheet; and a strip of flexible material separate and distinct from the front and back sheets, the strip of flexible material being coupled to the inner surfaces of the front and back sheets at a location that is adjacent to the lower edges of the front and back sheets;

wherein the capsule body comprises a releasable seal in an outlet region, and wherein a lower portion of the strip of flexible material extends between the releasable seal and the lower edges of the front and back sheets of flexible film material.

17. The beverage preparation capsule according to claim 16 wherein the strip of flexible material extends inwardly from the inner surfaces of the front and back sheets to form a rounded portion of the strip of flexible material.

18. The beverage preparation capsule according to claim 16 wherein the front and back sheets are not directly bonded to one another along the outlet region of the capsule body.

19. The beverage preparation capsule according to claim 16 wherein the strip of flexible film material comprises an outer surface that is bonded to each of the front and back sheets of flexible film material, a central portion that extends between the front and back sheets of flexible film material, and an inner surface that is bonded to itself to form the releasable seal in the outlet region.

* * * * *